US009839575B2

(12) United States Patent
Slocum et al.

(10) Patent No.: US 9,839,575 B2
(45) Date of Patent: Dec. 12, 2017

(54) MASSAGING DEVICE

(71) Applicant: Raptors Design, Inc., Bow, NH (US)

(72) Inventors: Alexander H. Slocum, Bow, NH (US); Folkers E. Rojas, Houston, TX (US)

(73) Assignee: RAPTORS DESIGN, INC., Bow, NH (US)

( * ) Notice: Subject to any disclaimer, the term of this patent is extended or adjusted under 35 U.S.C. 154(b) by 56 days.

(21) Appl. No.: 15/213,170

(22) Filed: Jul. 18, 2016

(65) Prior Publication Data

US 2017/0273859 A1 Sep. 28, 2017

Related U.S. Application Data

(60) Provisional application No. 62/313,734, filed on Mar. 26, 2016.

(51) Int. Cl.

| | |
|---|---|
| ***A61H 15/02*** | (2006.01) |
| ***A61H 15/00*** | (2006.01) |
| ***A61H 23/02*** | (2006.01) |

(52) U.S. Cl.

CPC ..... *A61H 15/02* (2013.01); *A61H 15/0092* (2013.01); *A61H 23/0263* (2013.01);

(Continued)

(58) Field of Classification Search

CPC ..... A61H 1/00; A61H 1/006; A61H 1/008; A61H 1/0266; A61H 7/00; A61H 7/002; A61H 7/007; A61H 15/00; A61H 15/0092; A61H 15/02; A61H 2015/0007–2015/0071; A61H 35/006; A61H 39/00; A61H 39/007–39/06; A61H 2201/164–2201/1642; A61H 2205/12–2205/125

See application file for complete search history.

(56) References Cited

U.S. PATENT DOCUMENTS

| | | | |
|---|---|---|---|
| 3,279,462 | A | 2/1964 | Niquet |
| 4,796,616 | A | 1/1989 | Panahpour |

(Continued)

FOREIGN PATENT DOCUMENTS

| | | | |
|---|---|---|---|
| CN | 2734217 | Y | 10/2005 |
| DE | 200 02 401 | U1 | 4/2000 |

(Continued)

OTHER PUBLICATIONS

Machine English Language translation of DE 200 02 401 U1, published Apr. 20, 2000.

(Continued)

*Primary Examiner* — Rachel Young

(74) *Attorney, Agent, or Firm* — DLA Piper LLP (US)

(57) ABSTRACT

Disclosed herein is a massage device configured to provide a squeezing pressure. The massage device may include an elastically extensible and bendable connector element and at least two rolling massage elements. A portion of the elastically extensible and bendable connector element and the at least two rolling massage elements form a massaging zone configured to receive one or more body parts. The body parts may include feet, forearms, and the like. Accordingly, the massage device may provide relief for specific conditions such as plantar fasciitis and carpel tunnel syndrome.

34 Claims, 13 Drawing Sheets

(52) U.S. Cl.
CPC ..... *A61H 2015/005* (2013.01); *A61H 2201/0207* (2013.01); *A61H 2201/1215* (2013.01); *A61H 2205/12* (2013.01)

(56) References Cited

U.S. PATENT DOCUMENTS

| | | | | |
|---|---|---|---|---|
| 4,846,159 | A | 7/1989 | Anzai et al. | |
| 5,492,526 | A | 2/1996 | Chen | |
| 5,580,336 | A | 12/1996 | Coallier | |
| 5,643,164 | A * | 7/1997 | Teff | A61H 1/0266 482/146 |
| 6,299,585 | B1 | 10/2001 | Yoo | |
| 8,740,825 | B2 * | 6/2014 | Ehrenreich | A61H 1/00 381/151 |
| 9,039,641 | B1 * | 5/2015 | Johnson | A61H 15/00 601/136 |
| 2003/0010744 | A1 * | 1/2003 | Ma | A61H 15/0092 215/382 |
| 2004/0091332 | A1 * | 5/2004 | Kuntze | F16B 5/0642 411/107 |
| 2005/0096201 | A1 * | 5/2005 | Thelen | A63B 21/055 482/124 |
| 2006/0089578 | A1 | 4/2006 | Hsu | |
| 2008/0103421 | A1 | 5/2008 | Nicholson | |
| 2010/0036297 | A1 * | 2/2010 | Kim | A61H 23/0236 601/49 |
| 2011/0313333 | A1 | 12/2011 | Nicholson | |
| 2012/0253248 | A1 * | 10/2012 | Carlson | A61H 15/00 601/128 |
| 2013/0123676 | A1 * | 5/2013 | Fallstich | A61H 15/0092 601/118 |
| 2014/0350443 | A1 | 11/2014 | Raines et al. | |
| 2015/0224016 | A1 * | 8/2015 | Holland | A61H 15/00 601/131 |
| 2015/0272774 | A1 * | 10/2015 | Lee | A61F 7/00 601/15 |
| 2015/0297932 | A1 * | 10/2015 | Wehrell | A63B 21/00076 482/129 |
| 2016/0235625 | A1 * | 8/2016 | Lee | A61H 39/04 |

FOREIGN PATENT DOCUMENTS

| | | |
|---|---|---|
| DE | 202015005165 | 10/2015 |
| EP | 0294513 B1 | 12/1988 |
| GB | 2370991 A | 7/2002 |

OTHER PUBLICATIONS

Machine English Language translation of DE 202015005165, published Oct. 23, 2015.

Machine English Language translation of CN 2734217Y, published Oct. 19, 2005.

* cited by examiner

MASSAGING DEVICE

CROSS REFERENCE TO RELATED APPLICATIONS

This application claims priority to US Provisional Patent Application No. 62/313,734, filed on Mar. 26, 2016, the entire contents of which are incorporated by reference, as is fully set forth herein.

FIELD OF THE INVENTION

The present invention, relates to a device for massaging one or more surfaces of a user.

BACKGROUND OF THE INVENTION

Athletes, especially long distance runners, and people who spend a lot of time on their feet (i.e., doctors, nurses, factory workers, and sales persons, to name a few) often get sore feet or damage their feet to the point of developing a debilitating condition such as plantar fasciitis. Plantar fasciitis is a condition in which the flat band of tissue (ligament) connecting the heal bone to the toes is weak, irritated, and/or swollen. Commercially available foot rollers purport to help relieve foot discomfort associated with plantar fasciitis. Conventional foot rollers may nominally be categorized into three groups: 1) rigid and non-rigid shafts with rolling members, 2) cylindrical shapes with concavity and/or external features, and 3) spherical semi-deformable devices.

The first group of foot rollers typically has a shaft passing through semi-deformable spherical, cylindrical or barrel shaped rolling elements that rotate around the axis of the shaft (e.g., an axle). Several rows of such rollers may be incorporated into a single device. Although the rolling elements may rotate about the axis of the shaft, which remains essentially straight, the spacing of the rolling elements remains constant.

In such devices a user applies both a vertical downward load and a transverse load to move the foot along the rollers causing different contact points of the rollers to interact with the bottom of the user's foot. These devices may also be used to roll the leg and other muscles. Under the nominal load of a person, pushing their feet down onto the rolling elements, the rolling elements transfer the applied loads to the ground directly or via the mounting structure with minimal deformation to a rigid axial shaft.

Other devices included in this category are roller ball devices where rolling elements such as spheres are allowed to roll but are constrained to stay attached to one or more structural elements of the device such as the rigid axial shaft. Again, the spacing of the rolling elements along the axis of, revolution is relatively constant.

Even in conventional foot rollers with non-rigid, flexible shafts such as a rope, the distance between the rolling elements (i.e., spheres) remains constant thereby greatly limiting the regions the user is able to massage. For example, the conventional foot roller may not be able to simultaneously massage the heel of the foot, and/or the two sides of the foot. Accordingly there is a need for massage devices that are able to roll, and provide constant contact to multiple surfaces of the foot.

A third group of foot rollers includes semi-deformable spherical, cylindrical or barrel shaped rollers which may be used either individually or as a group. The semi-deformable foot rollers may include foam or rubber features that interact with the bottom of the foot. In this group of foot rollers as the semi-deformable features are compressed, a transverse force causes the rollers to rotate along the bottom of the foot, and the transverse force causes the device to roll along the floor as the user applies a significant vertically downward load. Notably, these designs are prone to slippage as the device rolls.

Another part of the third group of foot rollers includes spherical semi-deformable devices. The spherical semi-deformable devices may include items like tennis balls, spheres with surface features (i.e. spikes). and/or peanut shaped devices. The spherical semi-deformable devices may be used to massage surfaces of the body. However conventional foot rollers from the third group are unable to massage both sides of the foot simultaneously. Additional products not used for massage from other industries include spherical semi-deformable devices such as dog toys, tennis balls and the like. However, none of devices may be used effectively for massaging the feet and other body parts.

Accordingly, there exists a need for a massage device that provides massage to various surfaces of a body part simultaneously.

SUMMARY

The present invention relates to a device configured to provide a squeezing massage pressure to at least one body part of a user.

In an exemplary embodiment of the invention, the massage device includes at least two rolling, massage elements, and an elastically extensible and bendable resilient connector configured to pass through and loosely connect each of the at least two rolling massage elements. The at least two rolling massage elements and a portion of the elastically extensible and bendable resilient connector element therebetween form a massaging zone configured to receive at least one body part. One or more surfaces of the at least one body part are in contact with at least one of the at least two rolling massage elements. The massaging zone is configured to provide a squeezing massage pressure to the at least one body part of a user in proportion to the extension of the said elastically extensible and bendable resilient connector element, to the contacted one or more surfaces of the at least one body part when said body part is between said rolling massage elements and the body part moves back and forth causing the rolling massaging elements to roll on a surface and against the body part.

BRIEF DESCRIPTION OF THE DRAWINGS

The invention will be better understood with reference to the following detailed description, of which the following drawings form an integral part.

Figure 1:
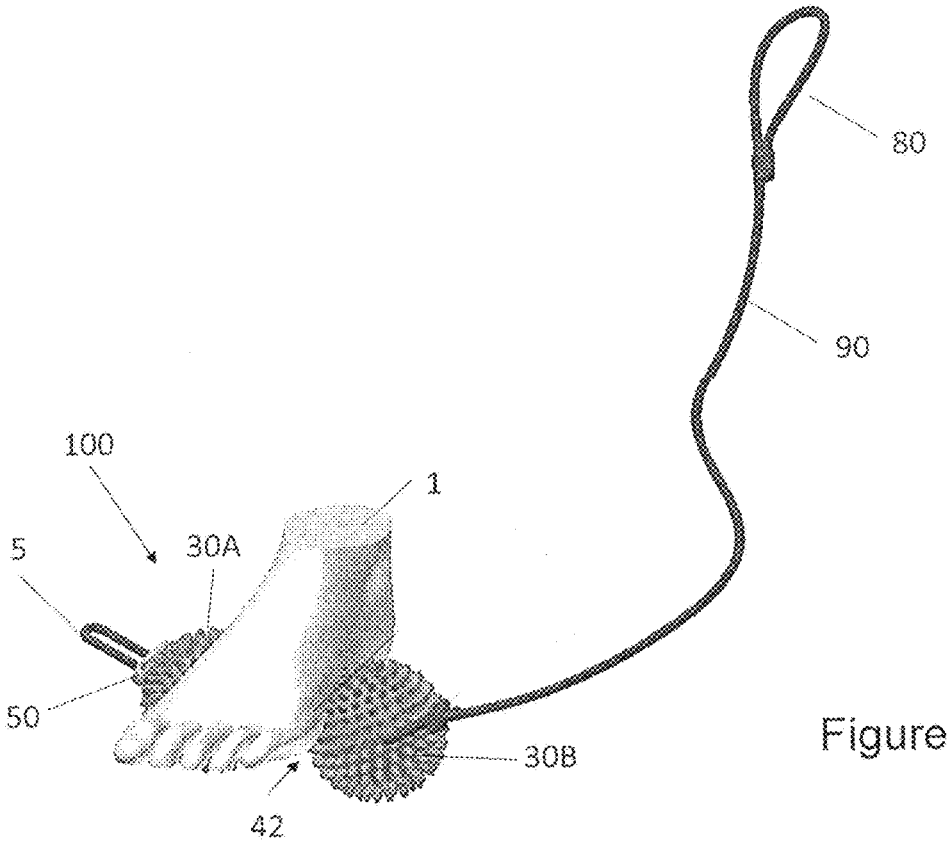
FIG. 1 is an isometric view of a foot in contact with a first exemplary embodiment of the device having a leash and handle.

In the drawing, embodiments of the invention are illustrated by way of example, it being expressly understood that the description and drawings are only for the purpose of illustration, and are not intended as a definition of the limits of the invention.

DETAILED DESCRIPTION OF THE DRAWINGS

The present invention relates to a device configured to provide a squeezing massage pressure to at least one body part of a user, for example the foot or forearm. In an exemplary embodiment of the invention, the massage device includes at least two rolling massage elements, and an elastically extensible and bendable resilient connector (referred to herein as the "elastic connector element") configured to pass through and loosely connect each of the at least two rolling massage elements. The at least two rolling massage elements and a portion of the elastic connector element therebetween form a massaging zone configured to receive at least one body part. One or more surfaces of the at least one body part are in contact with at least one of the at least two rolling massage elements. The massaging zone is configured to provide a squeezing massage pressure in proportion to the extension of the said elastically extensible resilient connector element, to the contacted one or more surfaces of the at least one body part when said body part is between said rolling massage elements, as the body part moves back and forth causing the rolling massaging elements to roll on a surface and against the body part.

In an exemplary embodiment, the at least one body part may include various surfaces of the feet, forearms, or other body parts. The rolling massage elements can be placed on the floor for massaging the feet or on a table or wall for massaging the forearm. The exemplary embodiments described herein may provide general health and comfort for the user and provide relief for specific conditions such as plantar fasciitis and carpel tunnel syndrome.

As will be discussed in relation to the exemplary embodiments depicted in FIGS. 1-13, each of the at least two rolling massage elements may be resilient, made of a rubber or thermoplastic elastomer as described for the elastic cord below. A range of hardness may be selected to provide different devices for different massage experiences required by different people. The rolling elements may also be made of a hard rubber or even hard plastic or wood to provide a deep tissue massage. The rolling massage elements may be configured to deform (bend, stretch, compress) when pressure is applied by the at least one body part in contact with the massage element. The rolling massage element may be resilient and configured to return to its original shape when the at least one body part is no longer in contact with the massage element. Each, of the massage elements, although not necessarily purely spherical, should be capable of rolling motion. In particular, rolling motion may involve rotation of the outer surface of the rolling massage elements about a central axis of the rolling massage element and a translation motion along a surface the roiling massage element is in contact with. In one embodiment, the rolling massage elements may be rolled along a floor or wall.

Each of the rolling massage elements may have various hardness configurations in accordance with the desired pressure of the massage. For example, a softer pressure may be attained by rolling massage elements made of a rubber or thermoplastic elastomer having a Shore A durometer on the order of 30-60. A firmer pressure may be attained by rolling massage elements having a Shore A durometer on, the order of 60-100. In one embodiment, the hardness of the rolling massage elements may be selected by way of user focus groups.

The rolling massage elements may be made from rubber or thermoplastic polymers with a durometer chosen depending on the desired pressure of the massage. For example, in an exemplary embodiment, the rolling massage elements may be made of a high grade of silicone rubber such as Silicon Rubber-SILPURAN 6000 series (e.g., 6000/30A WE08186) from Wacker Chemical in Germany. Dupont Hytrel and ExxonMobile Santoprene are also options. The exact material selected will depend on a number of factors, for example, mobilability to obtain the desired surface features and "feel" of the balls, as well as price and availability. The material used must be safe for contact with human skin (avoid allergic reactions such as can occur with latex) and should be cleanable with alcohol. Rubber or thermoplastic polymers used to construct the rolling massage elements may be selected with help from "Minnesota Rubber and Plastics Elastomers and Thermoplastics Engineering Design Guide" which is available free online. Although synthetic rubber or thermoplastic polymers are described herein, it is envisioned that the rolling massage elements may be made of any material suitable for providing the required squeezing pressure and feel when used in conjunction with the elastic connector elements.

Each of the rolling massage elements may be of the same or varying sizes. In an exemplary embodiment, the rolling massage elements may have a diameter from about 2 to 4 inches. The rolling massage elements may be of any shape suitable for rolling and applying a squeezing pressure to one or more body parts in contact with the massaging zone. For example, in one embodiment, the rolling massage elements may be spherical. In other embodiment, the rolling massage elements may be polyhedral, such as a regular dodecahedron or a convex regular isocahedron, or even an oblong shape.

In one embodiment, each of the rolling massage elements may have a smooth outer surface. For example, each of the rolling massage elements may be covered by a smooth cloth or fiber cover. Alternatively, the surface of each of the rolling massage elements may include protruding features. The protruding features may include, for example, frustoconical spikes. Each of the protruding features may have a height of about 5-20 mm embodiment with a smooth outer surface may be favored by users having delicate skin, diabetes, or other conditions. An embodiment having protruding features may be favored by users such, as athletes. The outer surface of each of the rolling massage elements may include one or more descriptive labels such as the shape or logo of a corporation or an event. Accordingly, the devices described herein may be used as promotional items.

In one embodiment, each of the rolling, massage elements may be hollow with an external layer. The external layer of the rolling massage elements may have a thickness proportional to the size of the rolling massage element. For example, in the illustrated embodiments, the rolling massage elements have an external layer with a thickness on the order of 5-10% of the length of the diameter of the rolling massage element. The thickness of the external layer may be configured such that the rolling massage elements are configured to mold to the one or more body parts in contact with the rolling massage elements in the massaging zone. In an exemplary embodiment, each of the rolling massage elements may include an internal finable volume that may be filled with an interior material. The interior material may have a bladder filled with a liquid or gas, or it may be filled simply with a closed-cell polyurethane foam rubber, and the like, in one embodiment, a user may pour hot or cold liquid into the interior tillable volume of the rolling massage elements similar to a hot water bottle. In one embodiment, closed-cell polyurethane foam rubber may be introduced to the internal finable volume to increase the stiffness of the rolling massage elements. Accordingly, the interior material of the rolling massage elements may be used to adjust the hardness of the rolling massage elements should they be molded and be hollow. Optionally, utilizing the interior material to adjust the durometer of the external layer of the rolling, massage elements may allow for the use of less expensive natural rubbers with suboptimal hardness and modifying the hardness of the device using closed-cell polyurethane. In one embodiment, solid spheres made from a softer material such as foam rubber may be used.

Although the embodiments depicted in FIGS. 1-13 may include two rolling massage elements, alternative embodiments of the invention may include three or more rolling massage elements. For example, an embodiment of the device with, three or four rolling massage elements connected by a common elastic connector element may allow the user to massage both sides of both feet at the same time. However, it is noted that an embodiment with fewer rolling massage elements may be more compact, easier to use, and portable than one with a greater number of rolling massage elements.

As will be discussed in relation to the exemplary embodiments depicted in FIGS. 1-13, the elastic connector element may be configured to pass through the one or more rolling massage elements. The elastic connector element may be stretchable and resilient. In particular, the elastic connector element may be configured to stretch to a length that is at least 30% longer than its unstretched length. In one embodiment, the elastic connector element may resiliently stretch up to 80% longer than its unstretched length. Additionally, the elastic, connector element may be configured to be resilient and return to its unstretched length when forces are no longer applied to the elastic connector element. The elastic connector element may be made of a "bungee" cord having inner rubber strands, which are braided. The elastic connector element may be covered by a woven element. The elastic connector element may be purchased in different diameters, elasticities, and colors from any vendor. For example, the elastic connector element may include materials obtained from the McMaster-Carr corporation, such as (http://www.mcmaster.com/#catalog/122/1555/=12t1gr5). The elastic connector element may have a diameter in the range of 3-8 mm. In an exemplary embodiment the diameter of the elastic connector element may be in the range of approximately 3/16 to 1/4 inches (4.7 mm-6.4 mm). The elastic connector element is typically purchased from a supplier, where the actual material is not usually specified, although the cords are usually made from a synthetic rubber or thermoplastic elastomer. Usually the properties of the elastic cord are specified, for example, the allowable diameter range, the resilience (% elongation required which is typically 50%) and the desired force to cause full elongation. For a product that yields a light massage, the force to cause full extension of the cord should be only 1-2 pounds, and for a user that prefers a heavy massage, the force to cause full extension of the cord should be about 5-7 pounds. It is understood that there are many different types of users, so a wide range of selections should be made available; thus the range of cord materials and elasticity thereof may be selected based on end use applications.

As will be discussed in relation to the exemplary embodiments depicted in FIGS. 1-13, the massaging zone may provide a squeezing massage pressure to the one or more surfaces of the body part in contact with the massage elements. As will be discussed in relation to FIGS. 1-13, a user may place a body part within the massaging zone. The massaging zone may include the at least two rolling massage elements and a portion of the elastic connector element therebetween (discussed above). As a user's body part is placed within the massaging zone, the user may apply a force to separate the at least two rolling massage elements. In turn, the at, least two rolling massage elements apply a force to the one or more surfaces of the user's body part in contact with the at least two rolling massage elements. This force may be considered a squeezing massage pressure, in that the configuration of the at least two rolling massage elements applies pressure to two sides of the user's body part, thereby simulating a squeezing pressure.

The at least two rolling massage elements and the elastic connector element can be configured such that the massage elements are spaced apart while being connected by the elastic connector element; or they can be held (preloaded) together by the elastic connector element which is under tension at all times. By preloading the massage elements together, there is required, an initial force threshold to be reached before the massage elements begin to stretch the elastic connector element and pry apart.

The preload force is thus an initial force the user must overcome in order to stretch the elastic connector element and force the at least two rolling massage elements apart. The preloaded force may be proportional, to the total elastic stiffness of the massaging zone. In particular, the massaging zone may have a total elastic stiffness (K represents the stiffness of a specific element) $K_{total}=K_{elastic_connector_element}+K_{resilent_massage_elements}$. Only when the initial force is applied and exceeded will the total stiffness of the preloaded massage element system $K_{total}$ be overcome, and the two rolling massage elements will spread apart.

When the massaging elements are forced apart by a body part, the squeezing massage pressure is continuously applied to the one or more surfaces in contact with the device while the device is in motion, rolling, or stationary. When an initial preload is used, the resiliency and length of the elastic connector element prevents the strain (which is proportional to the percentage change in length) between the two rolling massage elements from varying greatly, thereby providing a more constant pressure to the one or more body parts. If there is an initial spacing between the massaging elements, then the squeezing force felt will be a more linear function of the width of the body part forced between the massaging elements. Moreover, the distance between the at least two rolling massage elements can be configured so that the massaging pressure can be uniform for variations in the width of the body part present in the massaging zone.

Various exemplary embodiments of the device will be discussed in relation to FIGS. 1-13.

FIG. 1 is an isometric view of a foot 1 in contact with a first exemplary embodiment of the device 100. The device 100 includes at least two rolling massage elements 30A, 30B, and an elastic connector element 42.

In one embodiment, the elastic connector element 42 may be configured to pass through at least a portion of each of the at least two rolling massage elements 30A, 30B. The elastic connector element 42 may be configured to connect each of the at least two rolling massage elements 30A, 30B. The device 100 may also include a leash 90 with a holding loop or handle 80 on a first end. The holding loop or handle 80 may be spaced away from the two rolling massage elements 30A, 30B. In general, the leash is most easily made from the same material as the elastic connector element, but a simple braided cord of 3-8 mm will also suffice. A second end of the leash 90 may attach to a rolling massage element 30B at or near the outer surface of the rolling massage element 30B. If the leash is made of the same material as the elastic connector element, it can be an extension of the elastic connector element. Alternatively, the leash can be looped through, tied, or crimp-connected to the elastic connector element.

The at least two rolling massage elements 30A, 30B and a portion of the elastic connector element 42 therebetween form a massaging zone configured to receive at least one body part, for example, a foot 1. In the illustrated embodiment, the first end of the elastic connector element 42 may be located within the rolling massage element 30B located closest to the handle 80. In the illustrated embodiment, the elastic connector element 42 originates in the rolling massage element 30B passes between the two rolling massage elements 30A and 30B into the rolling massage element 30A located furthest from the handle 80. The elastic connector element 42 is then configured to exit the rolling massage element 30A, pass through a lock element 50, form a loop 5, pass through the lock element 50 for a second time and re-enter the rolling massage element 30A. The elastic connector element 42 may then terminate within the rolling massage element 30A with the second end of the elastic connector element 42: the joint can be created outside the massage elements and then pushed inside to make a neater more aesthetically pleasing design (see element 349 in FIG. 3 for example). The size of loop 5 may determine the adjustable spacing between the two rolling massage elements 30A, 30B. In particular, the size of the loop 5 may be adjusted by the lock element 50. In one embodiment, the lock element 50 may be a toggle, knot, or any other element capable holding the size of the loop 5 constant. Thus the lock element 50 can also adjust the spacing between the rolling massage elements 30A, 30B. The loop is of a size to at least provide the width adjustment between the massaging elements, and would typically be about equal to the perimeter of a massaging element.

As illustrated in FIG. 1, the foot 1 may be placed within the massaging zone, thereby applying a force to stretch the elastic connector element 42 and separate the at least two rolling massage elements 30A, 30B. As the foot 1 applies this force, the at least two rolling massage elements 30A, 30B each apply a force upon the one or more surfaces of the foot 1 in contact with the rolling massage elements 30A, 30B. The forces applied by the rolling massage elements 30A, 30B provides a squeezing pressure upon the foot 1. Optionally, the lower surface of the foot 1 in FIG. 1 may also be in contact with the elastic connector element 42. However, a squeezing pressure may be applied to the foot 1 regardless of whether the entire foot 1 is within the massaging zone. The depicted rolling massage elements 30A, 30B may be hollow with frustoconical spikes.

Although, two rolling massage elements 30A, 30B are depicted in FIG. 1, the device 100 may include more than two rolling massage elements, and would thus be considered here as a second exemplary embodiment (not shown in the figures). In such an embodiment, the elastic connector element 42 can be configured to pass through at least a portion of all of the rolling massage elements. For example, in an interior rolling massage element located between two other rolling massage elements, the elastic connector element 42 may enter the interior rolling massage element at a first end of the interior rolling massage element, travel along an internal axis of the interior rolling massage element, and exit out of the interior rolling massage element at a second end of the interior rolling massage element.

Figure 2:
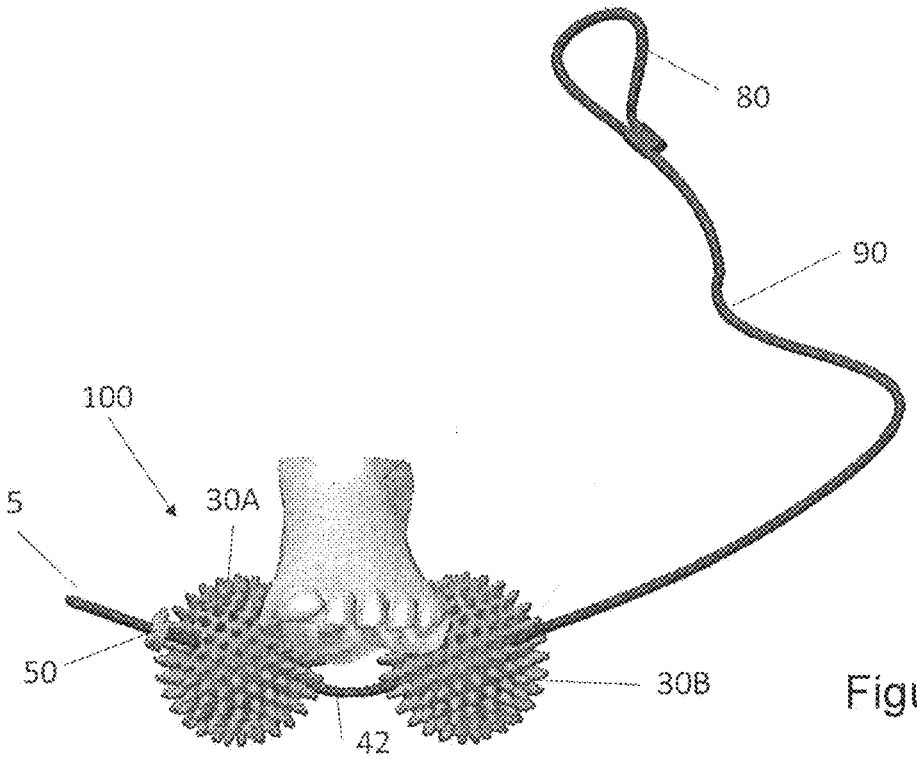
FIG. 2 is a front view of a foot in contact with the first exemplary embodiment of the device, as illustrated in FIG. 1.

FIG. 2 is a front view of a foot 1 in contact with the first exemplary embodiment of the device, as illustrated in FIG. 1. In FIG. 2, the rolling massage elements 30A, 30B are separated due to the load applied by the foot 1 which causes the elastic connector element 42 to expand to a stretched position. As shown in FIG. 2, the foot 1 presses between the at least two rolling massage elements 30A, 30B. A lock element 50 allows for the length of the elastic connector element 42 connecting the rolling massage elements 30A, 30B to be adjustable by the user. When the rolling massage elements 30A and 30B are closer together, the foot 1 contacts the rolling massage elements 30A, 30B near the top surfaces of the rolling massage elements 30A, 30B, respectively, thereby forming a shallower contact angle with the rolling massage elements 30A, 30B. Accordingly, the foot 1 must apply more downward force in order to stretch the elastic connector element 42 and further separate the two rolling massage elements 30A, 30B when the foot 1 contacts the rolling massage elements 30A, 30B near the top of the rolling, massage elements 30A, 30B.

Figure 3:
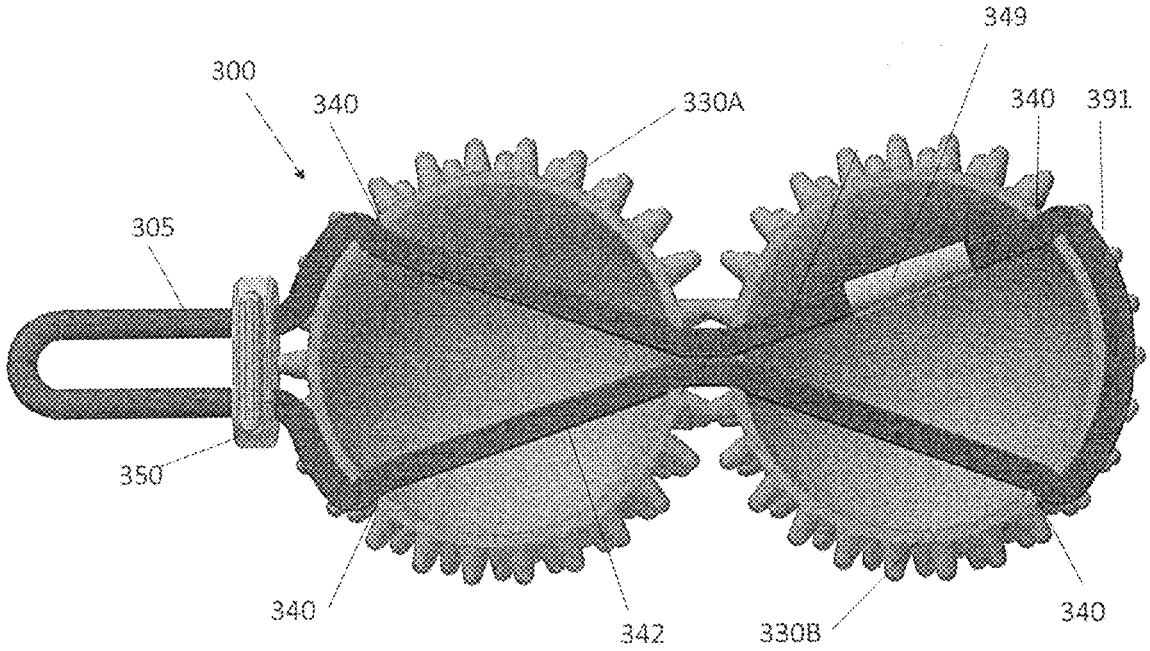
FIG. 3 is a cross-sectional front view of a third exemplary embodiment of the device having a crossing elastically extensible resilient connector element.

FIG. 3 is a cross-sectional front view of a third exemplary embodiment of the device 300, which is similar to the first embodiment, it just does not have the leash 90 attached. The exemplary embodiment of the device 300 has an elastic connector element 342 configured to form a generally "figure-8" shape. In one embodiment, the elastic connector element 342 necks down to the narrow portion of the "figure-8" shape between the two rolling massage elements 330A, 330B. The elastic connector element may originate and terminate within the same rolling massage element 330B. In particular, a first end and a second end of the elastic connector element 342 may attach inside rolling massage element 330B. The two ends of the elastic connector element 342 may attach in a connector 349 having two ports configured to receive the ends of the elastic connector element 342, respectively. Alternatively, the two ends of the elastic connector element 342 may be attached by adhesives or other means such as a crimp connector. When a solid synthetic rubber element is used, the ends can be joined by an adhesive. When a thermoplastic elastomer is used, it may be possible to weld the two ends together using a thermal process. At least a portion of the elastic connector element 342 may pass through the outer side 391 of at least one of the at least two rolling massage elements 330A, 330B. The elastic connector element 342 may pass through one or more exit ports 340 located on the outer surface of the rolling massage elements 330A, 330B and through a lock element 350 in order to form a loop 305. As illustrated in the figure the elastic connector element 342 may form a significantly "figure-8" shape. The configuration of the elastic connector element 342 in a "figure-8 shape" may provide a capstan effect that may aid the lock element 350, by making two tight turns and using friction to prevent slipping of the elastic connector element 342. As illustrated, each of the rolling massage elements 330A, 330B may include one or more exits ports 340 configured for elastic connector element 342 to enter or exit the rolling, massage elements 330A, 330B. The lock element 350 may be configured to adjust the length of the elastic connector element 342 and may be a toggle or any other suitable device. The lock element 350 allows the user to adjust the spacing between the rolling massage elements 330A, 330B and control the force needed to spread the rolling massage elements 330A, 330B apart with the foot 301 or other body part. Accordingly, the lock element 350 enables the user to massage different surfaces of the foot or other body part at varying levels of pressure.

Figure 4:
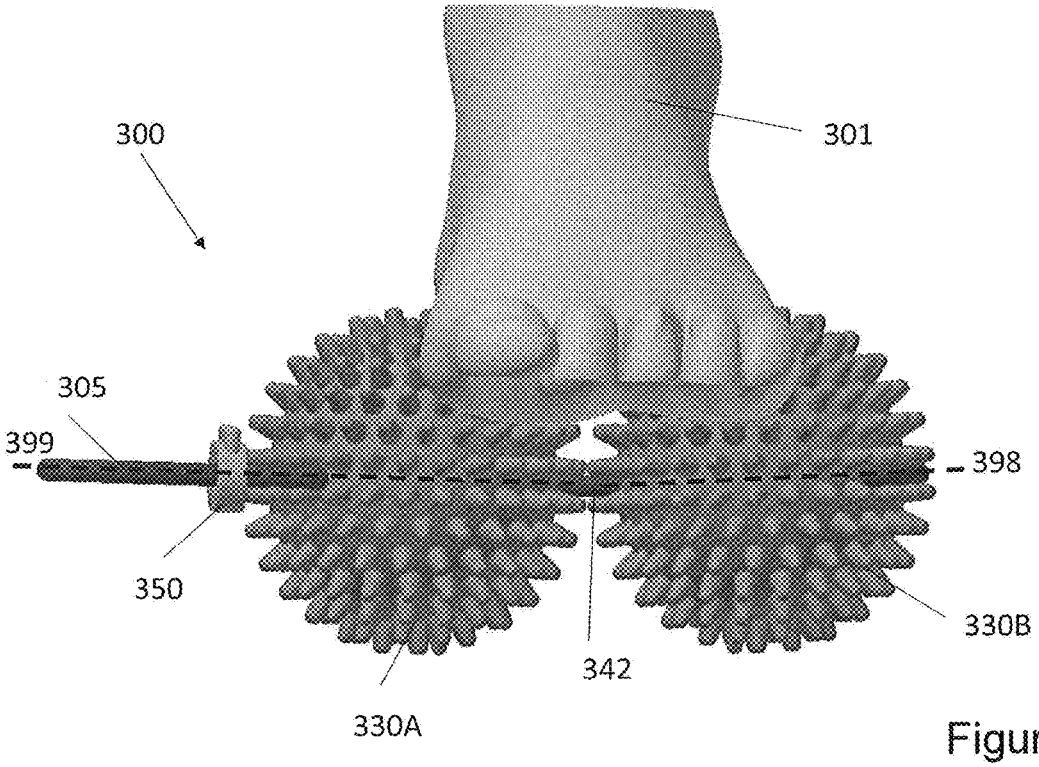
FIG. 4 is a front view of a foot in contact with the third exemplary embodiment of the device in a first partially-engaged position.

FIG. 4 is a front view of a foot 301 in contact with a third exemplary embodiment of the device 300 in a first partially-engaged position. In this first partially-engaged position, the foot 301 applies a pressure on the top surfaces of the at least two rolling massage elements 330A, 330B. A first end of the elastic connector element 342 originates within a first rolling massage element 330B. A second end of the elastic connector element 342 terminates within a second rolling massage element 330A after passing through a locking element 350 and forming a loop 305 similar to that described in relation to FIGS. 1-3. Each of the rolling massage elements 330A, 330B has a separate axis of rotation. As illustrated in FIG. 4, rolling massage element 330A has a first axis of rotation 399 and rolling massage element 330B has a second axis of rotation 398.

Figure 5:
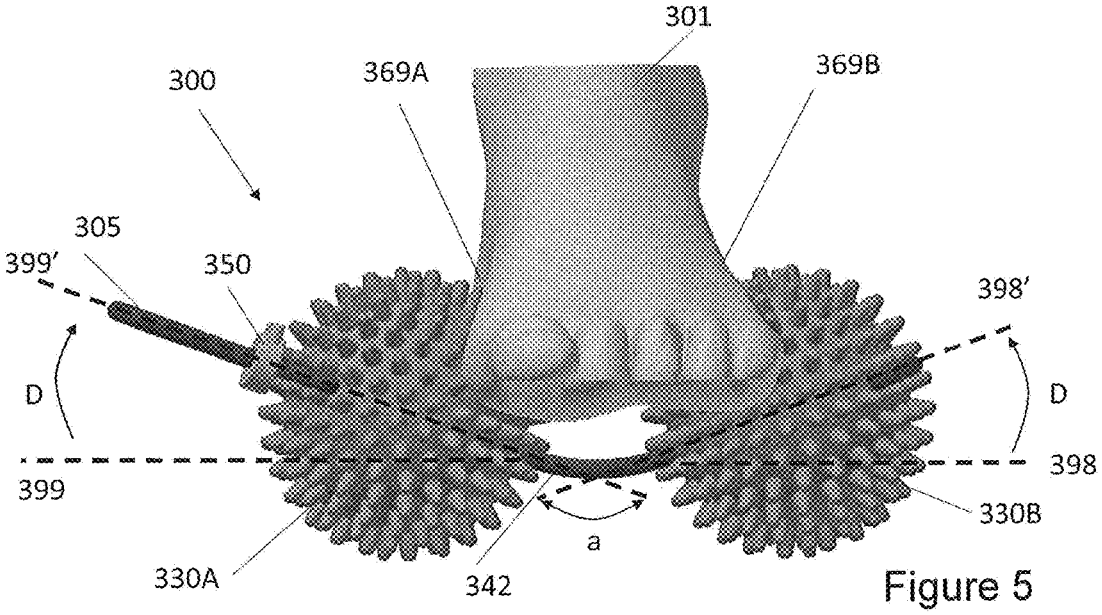
FIG. 5 is a front view of a foot in contact with the exemplary embodiment of the device illustrated in FIG. 4 in a second partially-engaged position.

FIG. 5 is a front view of a foot 301 in contact with the third exemplary embodiment of the device 300 illustrated in FIG. 4 in a second partially-engaged position. As shown in FIG. 5, the surfaces of the foot 301 in contact with the rolling massage elements 330A, 330B receive varied massaging pressure in accordance with the angle of the foot's 301 contact with the rolling massage elements 330A, 330B. The angle of the foot's 301 contact with the rolling massage elements 330A, 330B may be varied as the device 300 rolls along a surface.

Unlike conventional foot rollers, the axes of rotation 398, 399 of the rolling massage elements 330A, 330B changes dynamically based on the load applied by the user. This is due in part to the load being applied by the user causing the elastic connector element 342 to bend and/or stretch. As a load is applied by the user the axes of rotation 398, 399 of the rolling massage elements 330A, 330B move in direction D towards each other to form new axes of rotation 398', 399'.

Additionally, the elastic connector element 342 allows for the rolling massage elements 330A, 330B to undergo a pure rolling motion to lessen the differential slip between one or more surfaces of the foot 301 in contact with the rolling massage elements 330A, 330B near the axes 398', 399' and the one or more surfaces of the foot 301 in contact with the rolling massage elements 330A, 330B further away from the axes 398', 399'. The differential slip is due to the foot 301 traveling at a fixed velocity while the velocity of the surface of the rolling massage elements 330A, 330B may be equal to the product of the rotation rate of the rolling massage element 330A, 3303 and the distance from the axes 398', 399' to the contact point on the foot's 301 surface. Thus, the greater the difference in distances from the axes of rotation 398', 399' to the points of contact on the surface area being massaged, the greater the differential slip. Increased differential slip is associated with greater chances of the massaging surface developing abrasions and may cause discomfort to the user. As the elastic connector element 342 is elastic and used to connect the rolling massage elements 330A, 330B, the user may spread the rolling massage elements 330A, 330B apart, thereby maneuvering the rolling contact across many different surfaces of the foot 301, and adjusting the orientation of the axes of rotation 398', 399' to reduce the differential slip. Thus the device 300 provides improved comfort to a user when compared to conventional foot rollers.

Figure 6:
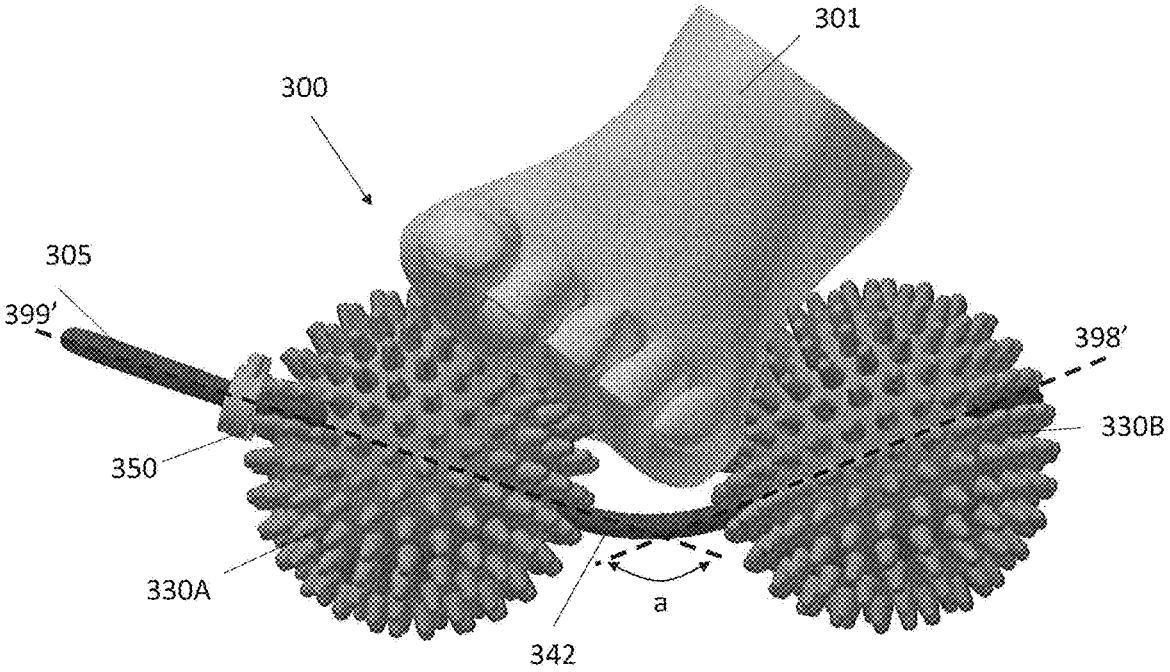
FIG. 6 is a front view of a rotated foot in contact with the third exemplary embodiment of device illustrated in FIGS. 4-6 in a third partially-engaged position.

FIG. 6 is a front view of a rotated foot in contact with the third exemplary embodiment of device illustrated in FIGS. 4-5 in a third partially-engaged position. As illustrated in the figure, the foot 301 may be engaged with the massaging zone at an angle, thereby contacting different surfaces of the foot 301 with the rolling massage elements 330A, 330B. As illustrated a first rotation axis 399 may form an angle 'a' with respect to the second rotation axis 398 as the foot 301 places varying pressures on the two rolling massage elements 330A, 330B.

Figure 7:
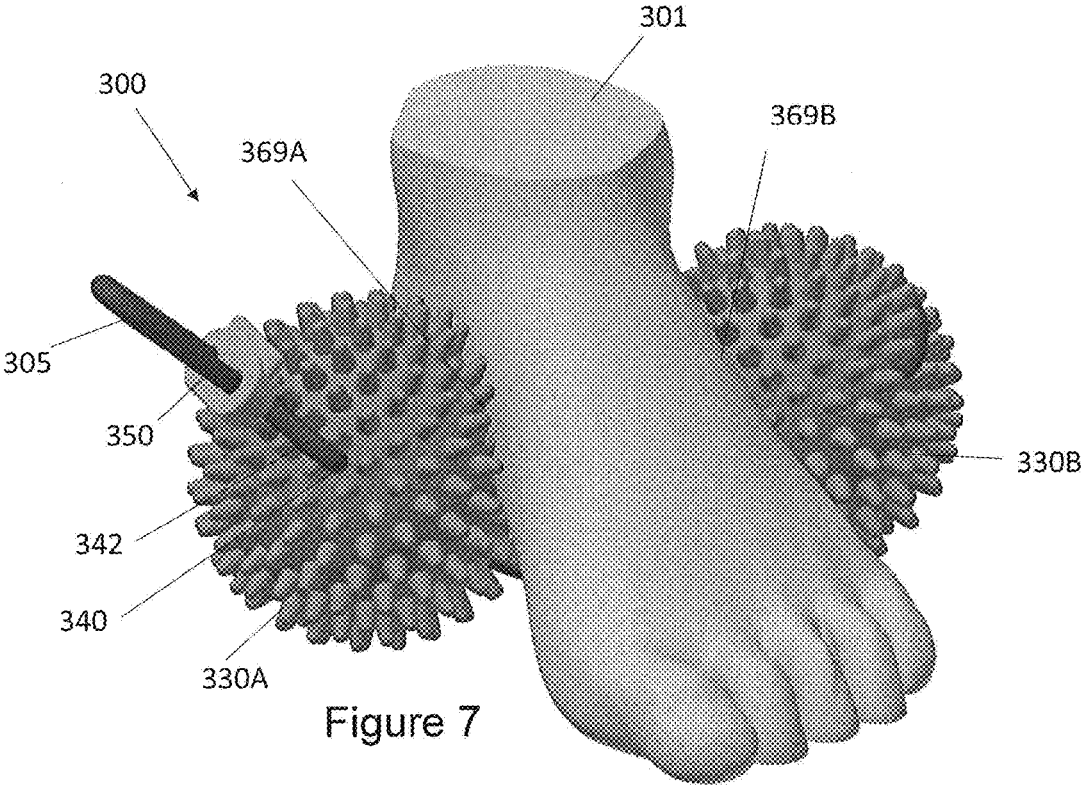
FIG. 7 is a front isometric view of a foot in contact with the third exemplary embodiment of the device illustrated in FIGS. 4-6 in a fourth fully-engaged position.
Figure 8:
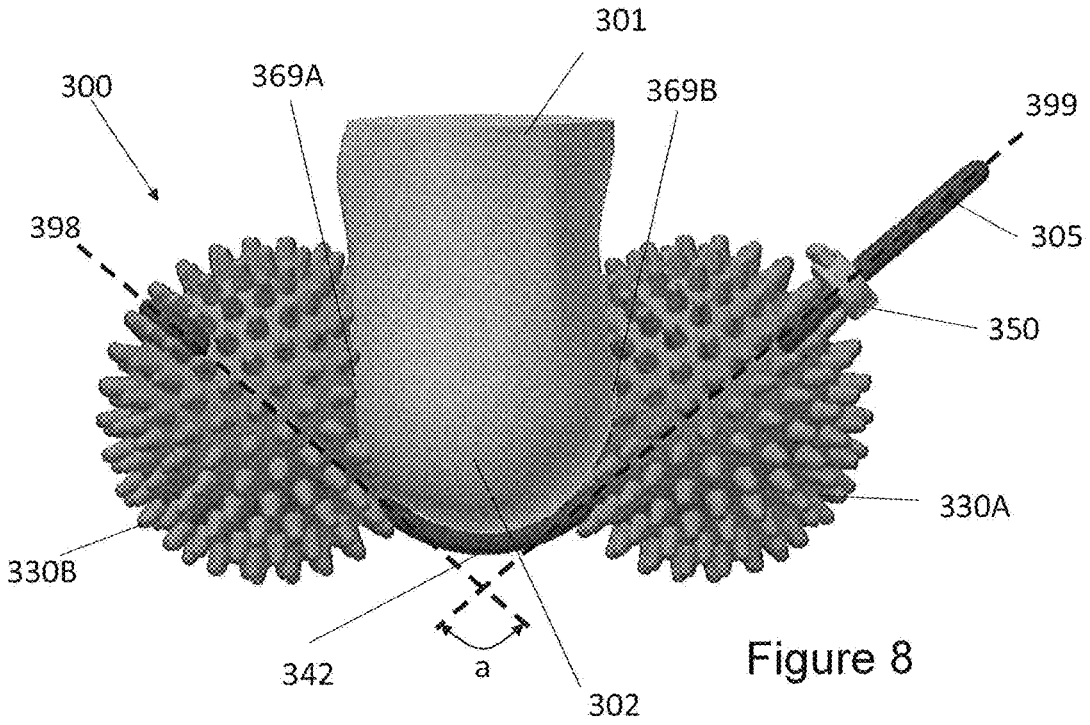
FIG. 8 is a rear view of a foot in contact with the third exemplary embodiment of the device illustrated in FIGS. 4-7 in a fourth fully-engaged position.

FIG. 7 is a front view of a foot 301 in contact with the third exemplary embodiment of the device 300 illustrated in FIGS. 4-6 in a fourth hilly-engaged position. As illustrated in the figure, in this fourth fully-engaged position, the foot 301 is in contact with the elastic connector element 342, and the sides 369A, 369B of the foot 301 are in contact with the rolling massage elements 330A, 330B. The elastic connector element 342 may pass through one or more exit ports 340 located on the outer surface of the rolling massage elements 330A FIG. 8 is a rear view of a foot 301 in contact with the third exemplary embodiment of the device illustrated in FIGS. 4-7 in the fourth fully-engaged position. As illustrated in the figure, in this fourth fully-engaged position, the heel 302 of the foot 301 is in contact with the elastic connector element 342, the sides 369A, 369B of the foot 301 are in contact with the rolling massage elements 330A, 330B, and the angle 'a' between the two axes 398, 399 approaches approximately 90 degrees.

Figure 9:
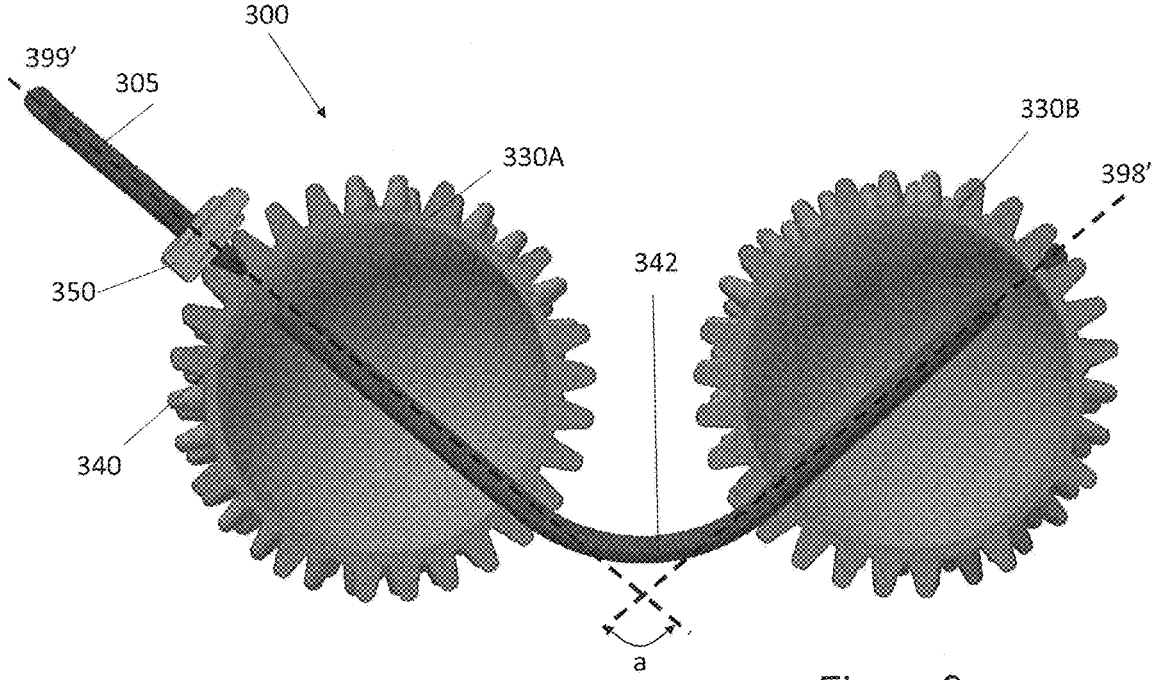
FIG. 9 is a cross-sectional view of the third exemplary embodiment of the device illustrated in FIGS. 4-8 in the fourth fully-engaged position of FIG. 8.

FIG. 9 is a cross-sectional view of the third exemplary embodiment of the device 300 illustrated in FIGS. 4-8 in the fourth fully-engaged position of FIG. 8 without the foot 301. As illustrated in the figure, the third exemplary embodiment of the device 300 may have a lock element 350 configured to be used with an elastic connector element 343 having a single strand. In one embodiment, the lock element 350 may be a clip lock. As the embodiment of the invention depicted in FIG. 9 does not include a FIG. 8 loop (and the resulting capstan effect of the FIG. 8 loop) less force will be required to separate the rolling massage elements 330A, 330B apart and the lock element 350 may be more likely to slip when compared to the second embodiment of the device 200 depicted in FIG. 3. The embodiment depicted in FIG. 9 may be preferred by those with more delicate skin such as older or younger people. The embodiment depicted in FIG. 9 may also be preferred by manufacturers who would prefer to reduce assembly costs by manufacturing an elastic connector element 342 having a single strand.

Figure 10A:
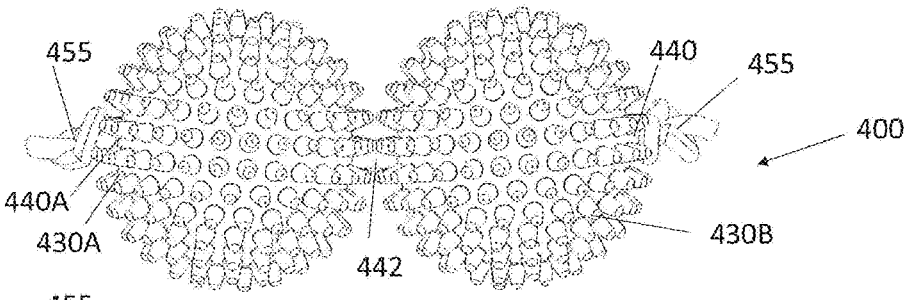
FIG. 10A is a front view of a fourth exemplary embodiment of the device with a fixed cord length.
Figure 10B:
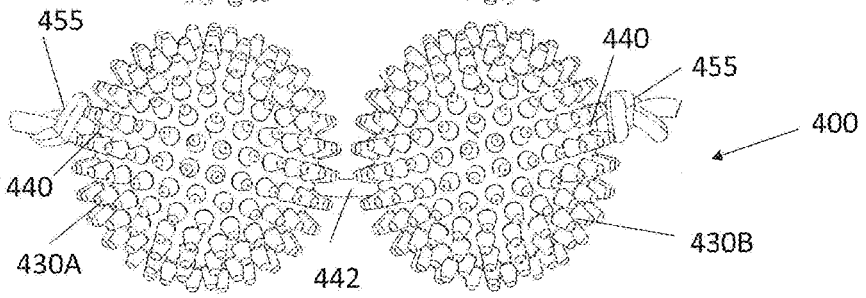
FIG. 10B is a front view of a fourth exemplary embodiment of the device with a second fixed cord length greater than the fixed cord length of FIG. 10A.
Figure 10C:
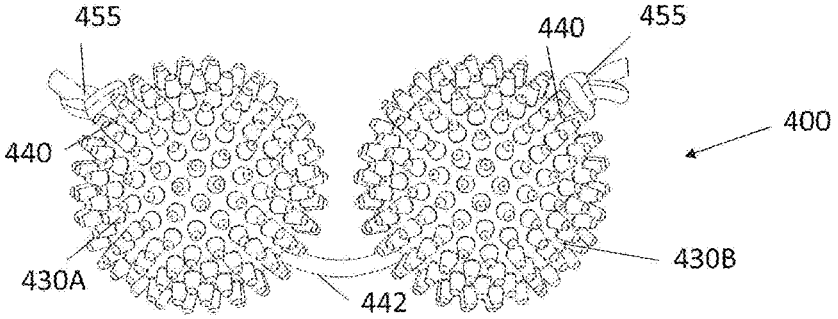
FIG. 10C is a front view of a fourth exemplary embodiment of the device with a third fixed cord length greater than the fixed cord lengths of FIGS. 10A and 10B.

FIGS. 10A-10C are front views of a fourth exemplary embodiment of the device 400 having a fixed cord length. The length of the elastic connector element 442 is increased from FIG. 10A to FIG. 10C. As illustrated in the figures, an elastic connector element 442 may pass through two or more rolling massage elements 430A, 430B. In the illustrated embodiment, the two ends 455 of the elastic connector element 442 may terminate outside of the rolling massage elements 430A, 430B, respectively, after passing through exit ports 440. In one embodiment, the ends 455 of the elastic connector element 442 may form knots. Alternatively, the ends 455 of the elastic connector element 442 may include crimp connectors, and the like. As the length of the elastic connector element 442 is increased from FIG. 10A to FIG. 10C the distance between the two rolling massage elements 430A, 430B also increases. This provides three different massage options, as users with wider feet or who want a lower squeezing force will use the option in FIG. 10C.

Figure 11:
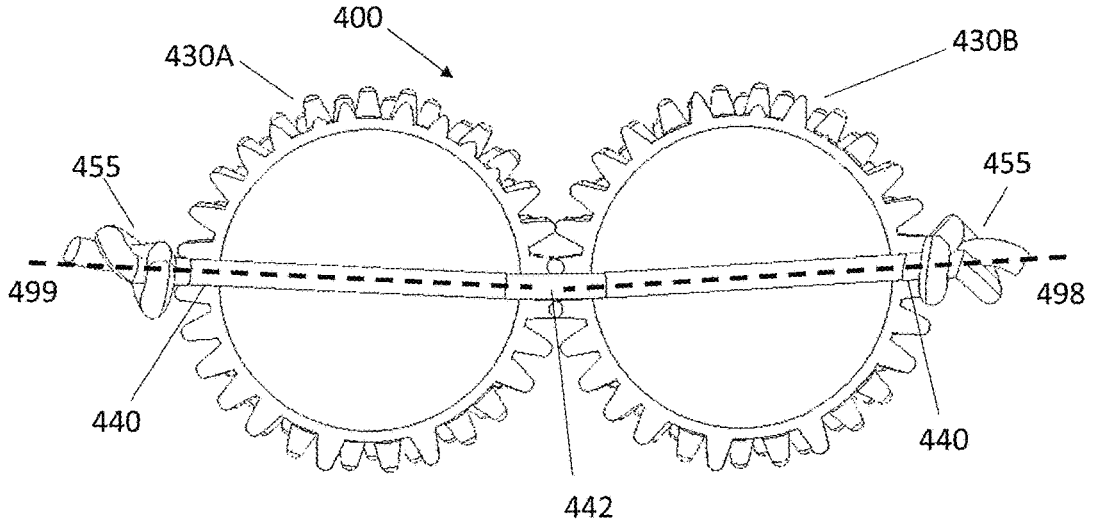
FIG. 11 is a cross-sectional view of the fourth exemplary embodiment of the device as illustrated in FIG. 10A.

FIG. 11 is a cross-sectional view of the fourth exemplary embodiment of the device 400 as illustrated in FIG. 10A. As illustrated, an elastic connector element 442 includes a single strand, passes through the rolling massage elements 430A, 430B and terminates at two ends 455. The axes of rotation 498, 499 of the rolling massage elements 430A, 430B may incline towards the foot as the foot is rolled between the rolling massage elements 430A, 430B. Thus the rolling massage elements 430A, 430B may roll along, a surface with minimal slip between the foot and the rolling massage elements 430A. 430B. This is especially desirable when the foot or other body part is positioned at an incline with respect to the rolling massage elements 430A. 430B as the rolling massage elements 430A, 430B roll along a surface.

Figure 12A:
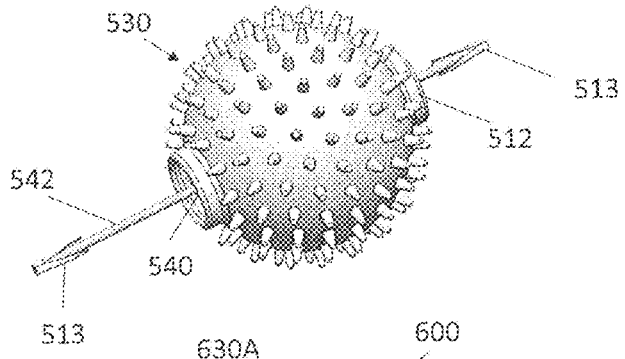
FIG. 12A is a front perspective view of a single massage element in a fifth exemplary embodiment of the device.

FIG. 12A is a front perspective view of a single rolling massage element 530 in a fifth exemplary embodiment of the device. In the fifth exemplary embodiment of the device the elastic connector element 542 may terminate at ends having barbs 513. The elastic connector element 542 may travel through the rolling massage element 530 and pass through exit ports 540. An elastic connector element 542 having barbed ends 513 may be assembled in an automated manufacturing process where it is placed through two rolling massage elements 500 to make a connected pair.

Figure 12B:
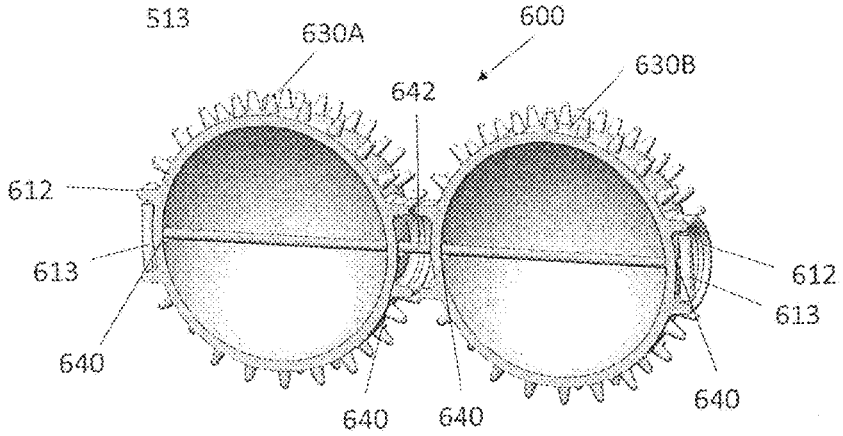
FIG. 12B is a cross-sectional perspective view of a sixth, exempla embodiment of the device.

In another preferred embodiment 600 shown in FIG. 12B a barbed elastic cord is used to make a connected pair of rolling massage elements as previously described. A barbed elastic cord costs more on a per part basis than a cord that is knotted to hold rolling massage elements 630A, 630B together in an assembly. However, the use of a barbed elastic cord requires less labor to assemble, and indeed it could even enable the assembly of the complete units to be automated. If the manufacturing of the device is automated, the device may be made most economically at point of sale and may contribute towards the preservation of local skilled automation-based jobs.

FIG. 12B is a cross-sectional perspective view of a sixth exemplary embodiment of the device 600. As illustrated, an elastic connector element 642 may pass through two rolling massage elements 630A, 630B and terminate at ends 613. In one embodiment, the ends 613 may include barbs. Each of the two rolling massage elements 630A, 630B may further include a cylindrical annular housing structure 612 configured to house the barb 613. The housing structure 612 may be positioned on the exterior side of the two rolling massage elements 630A, 630B, adjacent to exit ports 640 located about the rotation axis of each of the rolling massage elements 630A, 630B.

Figure 13:
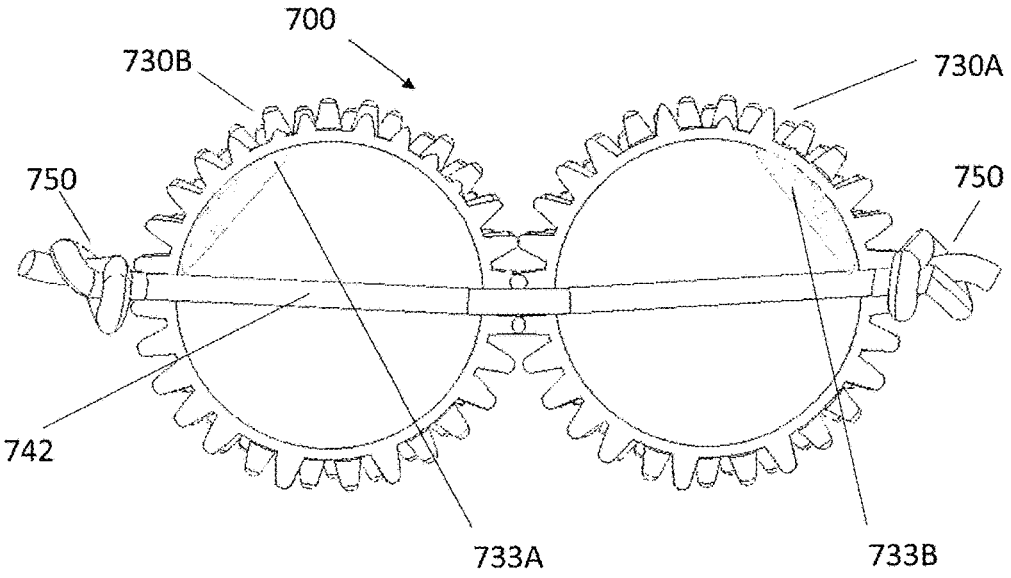
FIG. 13 is a cross-sectional view of a seventh exemplary embodiment of the device having a fixed cord length and electronic elements.

FIG. 13 is a cross-sectional view of a seventh exemplary embodiment of the device having a fixed elastic connector element length and electronic elements. The seventh exemplary embodiment of the device 700 includes an elastic connector element 742 configured to pass through at least two rolling massage elements 730A, 730B and terminate in knotted ends 750. One or more of the rolling massage elements 730A, 730B may include electronic elements 733A, 733B. In one embodiment, the electronic elements 733A, 733B may provide vibration or heat to a user. For example, massage vibration elements including a small motor with, an eccentric mass may be used. The rolling massage elements 730A, 730B may be configured to have one or more access ports through which an electronics module may be inserted and attached. The electronics module may be activated by a switch located at the center of the elastic connector element 742, by a wired switch, by a wireless switch, a pressure activated switch and the like. The electronics module may include a power source such as a battery. The power source may be rechargeable (and charged through an access port), or be disposable, similar to a watch battery. The electronic elements 733A, 733B may include an accelerometer and a microprocessor with the ability to record and wirelessly relay information to an external device, such, as a smartphone. This may allow a user to keep track of usage of the massaging device. This may be beneficial to the user for example when the massaging device is used as part of a therapy regimen that is prescribed by a health care provider.

Indeed, in all of the embodiments described above, the massaging device may be equipped with an electronic module including at least a small circuit hoard with microcontroller and sensors that track usage of the device and transmit information related to usage to external smart devices such as watches, phones, laptop, desktop, dedicated receivers and the like. The external smart device may be battery powered or be powered via an energy harvester device and the like. The electronics module may be located within one of the rolling massage elements 730A, 730B, exterior to the rolling massage elements 730A, 730B, or be, placed along the elastic connector element 742.

Although the FIGS. 1-13 have been described in relation to the at least one body part being feet, one skilled in the art would recognize that the described embodiments of the device may be used with many suitable body parts including the arms, wrist area, palms, and the like. For example, the described devices may be used to massage the forearm and provide relief for carpel tunnel syndrome. In such an application, the forearm is placed in the massaging zone, applying a downward force while rolling so as to spread the rolling massage elements apart so they provide a gentle squeezing pressure to both sides of the forearm. The continued rolling motion of the forearm and device provides a squeezing massaging pressure to the forearm thereby increasing circulation, releasing adhering tissue and providing much needed relief to those with, carpel tunnel syndrome.

The embodiments of the device may be used in many locations including in offices, classrooms, physical therapy, healthcare provider settings, or at home. The device may be used in reflexology.

All the embodiments of the device described herein may provide the user with a soothing effect, as the feet are well known to have reflexology regions. Massaging these reflexology regions may have positive effects on different parts of the body. This is a feature common to all foot massage devices. The present invention also offers the additional benefit in that it may be used for play value like a toy. This is due in part to the elastic connector element providing additional degrees of freedom, which enables a user to change the geometry of the device while using it, and massage a greater portion of the foot's surface. Additionally, a user may readily roll the device around on the floor in the space under a desk. This sort of activity takes the place of pen twirling, tapping, or even smoking as the pleasurable effect of massaging many of the foot's reflexology zones releases endorphins. Hence the device may be used as an office product that enhances productivity and happiness. In schools, students may even find massaging their feet during lectures helps them to concentrate.

In view of the foregoing detailed description of exemplary embodiments of the present invention, it readily will be understood by those persons skilled in the art that the present invention is susceptible to broad, utility and application. While various aspects have been described in the context of standalone application, the aspects may be useful in other contexts as well. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Furthermore, any sequence(s) and/or temporal order of steps of various processes described and claimed herein are those considered to be the best mode contemplated for carrying out the present invention. It should also be understood that, although steps of various processes may be shown and described as being in an exemplary sequence or temporal order, the steps of any such processes are not limited to being, carried out in any particular sequence or order, absent a specific indication of such to achieve a particular intended result. In most cases, the steps of such processes may be carried out in various different sequences and orders, while still falling within the scope of the present inventions. In addition, some steps may be carried out simultaneously. Accordingly, while the present invention has been, described herein in detail in, relation to exemplary embodiments, it is to be understood that this disclosure is only illustrative and exemplary of the present invention and is made merely for purposes of providing a full and enabling disclosure of the invention. The foregoing disclosure is not intended nor is it to be construed to limit the present invention or otherwise to exclude any such other embodiments, adaptations, variations, modifications and equivalent arrangements, the present invention being limited only by the claims appended hereto and the equivalents thereof.

Although the invention has been described in terms of exemplary embodiments, it is not limited thereto. Rather, the appended claims should be construed broadly to include other variants and embodiments of the invention, which may be made by those skilled in the art without departing from the scope and range of equivalents of the invention. This disclosure is intended to cover any adaptations or variations of the embodiments discussed herein.

We claim:

1. A massage device comprising:

two rolling massage elements, each of the rolling massage elements having three holes; and an elastic cord having an initial length and configured to connect the two rolling massage elements by passing through the three holes of each of the rolling massage elements, the massage device having a first state in which the two rolling massage elements are spaced a pre-determined distance apart, and the massage device having a second state in which the two rolling massage elements are spaced greater than the pre-determined distance apart, the massage device transitioning from the first state to the second state when one or more forces are applied to at least one of the two rolling massage elements and the elastic cord such that the elastic cord elastically stretches to a length longer than the initial length, and the massage device transitioning from the second state to the first state when one or more forces are removed from at least one of the two rolling massage elements and the elastic cord such that the elastic cord elastically contracts to the initial length, wherein the elastic cord elastically stretches and contracts without irreversibly slipping in each of the three holes of each of the two rolling massage elements.

2. The massage device of claim 1, wherein the two rolling massage elements are one of a spherical and a polyhedral shape.

3. The massage device of claim 1, wherein the two rolling massage elements have a surface of one of a smooth cloth or fiber cover, or covered with protruding features, each of which is selected to suit the needs of a user ranging from a delicate skinned person to a seasoned athlete.

4. The massage device of claim 1, wherein one or more of the two rolling massage elements further comprises one or more sensors, wherein each of the one or more sensors are connected to at least one of the rolling massage elements to collect and, on demand, provide usage data to one or more monitoring and/or control devices.

5. The massage device of claim 1, wherein one or more of the two rolling massage elements further comprises at least one of a device configured to vibrate, and a heating device.

6. The massage device of claim 1, wherein one or more of the two rolling massage elements further comprises an internal fillable volume.

7. The massage device of claim 1, wherein each of the two rolling massage elements is hollow.

8. The massage device of claim 1, wherein each of the two rolling massage elements is filled with an interior material, wherein the interior material further comprises at least one of a liquid, a gas, and a closed-cell resilient foam rubber.

9. The massage device of claim 1, wherein an outer surface of each of the two rolling massage elements further comprises one or more descriptive labels or protruding features, wherein the height of each of the one or more protruding features is about 5-20 mm in height.

10. The massage device of claim 9, wherein one of the one or more protruding features is a frustoconical spike.

11. The massage device of claim 1, wherein each of the two rolling massage elements is made of a material comprising at least one of natural rubber and thermoplastic polymers.

12. The massage device of claim 11, wherein the material has a durometer of about Shore A 30-90.

13. The massage device of claim 1, wherein each of the two rolling massage elements has a diameter of about 2-4 inches.

14. The massage device of claim 1, wherein the elastic cord has a diameter of about 3 to 10 mm, and the length longer than the initial length is at least 30% longer than the initial length.

15. The massage device of claim 1, wherein each of the two rolling massage elements is resilient.

16. The massage device of claim 1 further comprising an electronics module including a microcontroller and sensors to track usage of the device and transmit information related to usage to an external receiving device.

17. A massage device comprising:

at least two resilient rolling massage elements, wherein each of the at least two resilient rolling massage elements has at least three holes in its exterior surface of the resilient rolling massage element; and an elastically extensible and bendable cord connector element configured to pass through and connect each of the at least two resilient rolling massage elements, wherein the elastically extensible and bendable cord is configured to pass into a first resilient rolling massage element of the at least two resilient rolling massage elements through one of the at least three holes, out a second of the at least three holes, back into the first resilient rolling massage element through the third of the at least three holes and then back out of the first resilient rolling massage element, and wherein the elastically extensible and bendable cord is configured to pass into and out of a second resilient rolling massage element of the at least two resilient rolling massage elements through one of the at least three holes, out a second of the at least three holes, back into the second resilient rolling massage element through the third of the at least three holes and then back out of the second resilient rolling massage element, and wherein a force applied to separate the at least two resilient rolling massage elements causes the elastically extensible and bendable cord to elastically stretch and bend, thereby increasing the spacing between the at least two resilient rolling massage elements.

18. The massage device of claim 17, wherein:

The at least two resilient rolling massage elements each having said three holes in their exterior surfaces in communication with each other inside their respective resilient rolling massage elements and the elastically extensible and bendable cord is configured such that beginning on the outside of a first resilient rolling massage element of the two resilient rolling massage elements, the elastically extensible and bendable cord passes through a first hole among the three holes into the first resilient rolling massage element and out a second hole among the three holes and then passes through a first hole among the three holes of a second resilient rolling massage element into its interior and then out through a second hole of the three holes and then back through a third hole of the three holes into the interior and then out of the first hole of the second rolling massage element and then back through the second hole in the first resilient rolling massage element and then out of the third hole wherein two strands of the elastically extensible and bendable cord can then be connected to hold the at least two resilient rolling massage elements together at a desired distance apart or preload together such that there are two strands of the elastically extensible and bendable cord connecting the at least two resilient rolling massage elements.

19. The massage device of claim 18, further comprising the elastically extensible and bendable cord extending from the massage device, having exited the first and third holes of the first resilient rolling massage element forming a loop or handle.

20. The massage device of claim 17, wherein an outer surface of each of the at least two resilient rolling massage elements further comprises one or more protruding features shaped in cross section in the form of a descriptive label or corporate logo.

21. The massage device of claim 17, wherein each of the at least two resilient rolling massage elements further comprises a material having a durometer of in the range of Shore A 30 to Shore A 90.

22. The massage device of claim 17, wherein each of the at least two resilient rolling massage elements has a diameter in the range of 2 inches to six inches.

23. The massage device of claim 17, wherein the elastically extensible and bendable cord has a diameter in the range of 3 to 10 mm, and is stretchable to a length at least 30% longer than its unstretched length.

24. The massage device of claim 17 further comprising an electronics module including a microcontroller and sensors to track usage of the device and transmit information related to usage to an external receiving device.

25. The massage device of claim 17, wherein the at least two resilient rolling massage elements are one of a spherical and a polyhedral shape.

26. The massage device of claim 17, wherein the at least two resilient rolling massage elements have a surface of one of a smooth cloth or fiber cover, or covered with protruding features, each of which is selected to suit the needs of a user ranging from a delicate skinned person to a seasoned athlete.

27. The massage device of claim 17, wherein one or more of the at least two resilient rolling massage elements further comprises one or more sensors, wherein each of the one or more sensors are connected to at least one of the at least two resilient rolling massage elements to collect and, on demand, provide usage data to one or more monitoring and/or control devices.

28. The massage device of claim 17, wherein one or more of the at least two resilient rolling massage elements further comprises at least one of a device configured to vibrate, and a heating device.

29. The massage device of claim 17, wherein one or more of the at least two resilient rolling massage elements further comprises an internal fillable volume.

30. The massage device of claim 17, wherein each of the at least two resilient rolling massage elements is hollow.

31. The massage device of claim 17, wherein each of the at least two resilient rolling massage elements is filled with an interior material, wherein the interior material further comprises at least one of a liquid, a gas, and a closed-cell resilient foam rubber.

32. The massage device of claim 17, wherein an outer surface of each of the at least two resilient rolling massage elements further comprises one or more descriptive labels or protruding features, wherein the height of each of the one or more protruding features is about 5-20 mm in height.

33. The massage device of claim 32, wherein one of the one or more protruding features is a frustoconical spike.

34. The massage device of claim 17, wherein each of the at least two resilient rolling massage elements is made of a material comprising at least one of natural rubber and thermoplastic polymers.

* * * * *